United States Patent [19]

Oya et al.

[11] Patent Number: 4,765,242

[45] Date of Patent: Aug. 23, 1988

[54] DEVICE FOR CLEANING BLANKET MOUNTED AROUND CYLINDRICAL DRUM OF A PRINTING MACHINE

[75] Inventors: Motomichi Oya; Tsutomu Nonomura, both of Tokyo, Japan

[73] Assignees: Kabushiki Kaisha Asahi Shimbunsha; Toyo Inki Seizo Kabushiki Kaisha, both of Japan

[21] Appl. No.: 937,812

[22] Filed: Dec. 4, 1986

[51] Int. Cl.[4] ..... B41F 35/00

[52] U.S. Cl. ..... 101/425; 101/423

[58] Field of Search ..... 101/423, 425, 417, 418, 101/424

[56] References Cited

U.S. PATENT DOCUMENTS

| | | | |
|---|---|---|---|
| 794,487 | 7/1905 | Brod | 101/424 |
| 2,165,231 | 7/1939 | Curtis | 101/142 |
| 2,747,506 | 5/1956 | Ross et al. | 101/424 |
| 3,370,546 | 2/1968 | Müller | 101/425 |
| 3,389,656 | 6/1968 | Giori | 101/424 |
| 3,976,007 | 8/1976 | Junghans et al. | 101/425 |
| 4,232,604 | 11/1980 | Waizmann | 101/425 |
| 4,344,361 | 8/1982 | MacPhee et al. | 101/425 |

*Primary Examiner*—Edgar S. Burr

*Assistant Examiner*—James Lisehora

*Attorney, Agent, or Firm*—Stevens, Davis, Miller & Mosher

[57] ABSTRACT

This is a device for cleaning a blanket mounted around a cylindrical drum of a printing machine. The device has a vessel arranged to open upward with an upper opening thereof facing a downwardly convexed bottom portion of the blanket and supported to be movable up and down, a pair of rollers mounted in the vessel adjacent the opening thereof so as to carry a strip sheet material thereon as bridging therebetween, and a nozzle mounted in the vessel so as to project a jet flow of a cleaning fluid upward against the bridging portion of the strip sheet material. In cleaning operation, the bridging portion of the strip sheet material is pressed against the downwardly convexed bottom portion of the blanket by the pair of rollers with the vessel moved upward, and the blanket and/or the strip sheet material is moved relative to one another so that the blanket is given a rub cleaning action by the strip sheet material under supply of an effluent amount of the cleaning fluid which also agitates a layer of the cleaning fluid suspended in contact with the blanket by a substantial kinetic energy supplied with the jet flow.

10 Claims, 2 Drawing Sheets

DEVICE FOR CLEANING BLANKET MOUNTED AROUND CYLINDRICAL DRUM OF A PRINTING MACHINE

BACKGROUND OF THE INVENTION

1. Field of the Invention

The present invention generally relates to the art of printing machine, and more particularly, to a device for cleaning a blanket mounted around a cylindrical drum of a printing machine.

2. Description of the Prior Art

The lithographic printing system includes a blanket mounted around a cylindrical drum. Such a blanket operates to transfer an image layer of an ink from a press plate onto a print sheet by bearing the image layer of the ink on the outer surface thereof. In more detail, the press plate has a surface some portions of which selected according to an image to be printed are made to be hydrophobic, while the remaining portions of the surface are made to be hydrophilic, so that when the surface is uniformly supplied with an oily ink the surface bears a layer of the ink only at the hydrophobic portions thereof. The press plate may be in a flat form or in a cylindrical form mounted around a cylindrical drum. The blanket mounted around the cylindrical drum is first brought into contact with the press plate subsequent to the supply of ink thereon thereby to pick up the image layer of the ink, and is then brought into contact with a print sheet. When a number of the same press plates are needed for a large quantity of printing as in newspaper printing, the blanket mounted around the cylinder may be used to transfer an image layer of ink from an original press plate to a plurality of duplicate press plates.

Such a blanket needs to be periodically cleaned so that an accumulation of ink, fiber flocks or the like retained on the surface of blanket are removed before the accumulation reaches an allowable limit. The cleaning of the blanket has conventionally been done mostly by hand, using some conventional cleaning tools such as brushes or the like under a supply of a conventional cleaning fluid such as soapy water or the like. Although such manual cleaning is convenient in the sense that it needs no special equipments to be particularly installed in the printing system, it is bound to be a problem because degree of cleaning is not always desirably controlled. Too much brushing at a certain portion of the blanket will cause undesirable wearing of that portion, while insufficient brushing at another portion will cause an early degradation of a part of the blanket which is local but in any event limits the period of operation of the blanket between two successive cleanings.

Conventional cleaning devices for general use such as motor driven brushes or rollers may be used for the cleaning of the blanket thereby to increase the cleaning efficiency and thereby to shorten the time during which the printing machine must be stopped for cleaning. However, the cleaning by these conventional motor driven cleaning devices is still not free from the problem that the cleaning applied to different portions of the blanket is not uniform.

A highly mechanized device for cleaning the blanket mounted around a cylindrical drum of a printing machine is disclosed in U.S. Pat. No. 4,344,361. This device has a mechanism for selectively pressing successive portions of a cloth strip against the blanket when it needs cleaning so that the blanket is applied with a wiping-cleaning action by the cloth strip as the blanket is rotated in contact with the cloth strip. The cloth strip is wetted with a cleaning fluid at the portion thereof pressed against the blanket so as to increase the cleaning effect. The cloth strip is gradually fed to renew the portion thereof rubbed against the blanket as the cloth strip wears in use. In the embodiment shown in this U.S. patent specification, the device is mounted adjacent the cylindrical drum bearing the blanket therearound at a location between a top and a horizontal side portion of the cylindrical drum so that the portion of the cloth strip which is pressed against the blanket faces inclinedly downwardly. It is guessed from such a structure that the cloth strip in the device of this U.S. patent will not be properly wetted with the cleaning fluid as it oozes out downwardly from the cloth strip and flows over the blanket downwardly.

SUMMARY OF THE INVENTION

The inventors of the present application have found through experimental research that the cleaning efficiency, i.e., the degree of cleaning as well as the speed of cleaning, of the cleaning action of wiping the blanket with a rough and porous sheet material such as a woven or a nonwoven cloth or paper wetted with a cleaning fluid can be substantially increased by increasing the supply of the cleaning fluid so much that much of the cleaning fluid supplied to the sheet material flows over and away from the wiping area as an excessive flow which however provides the effect of carrying away ink, fiber flocks or the like retained on the blanket to be removed from the blanket.

On the other hand, it might be thought of by one of ordinary skill in the art to clean the blanket by projecting a flow of cleaning fluid onto the blanket by a nozzle means, since a water jet cleaning is long well known. Projection of a jet flow of a cleaning fluid against the blanket has a certain effect of removing ink, fiber flocks or the like retained on the blanket therefrom, principally by striking such ink or fiber flocks out from micro irregular surface structure of the blanket by the kinetic energy of the jet flow of the cleaning fluid. However, this cleaning mechanism has a self-conflict when applied to an object such as a blanket which has some micro interstices due to micro irregular surface structure because the kinetic energy applied by the jet flow of the cleaning fluid releases such ink or fiber flocks from holding by the micro irregular surface structure of the blanket but at the same time it drives such ink or fiber flocks into firmer engagement with the micro irregular surface structure of the blanket.

The inventors of the present application have conceived to combine the above-mentioned two technical concepts of cleaning in such a manner that a porous sheet material such as a woven or a nonwoven cloth or paper for wiping the blanket is supplied with the cleaning fluid as a jet flow projected against the sheet material so that an effluent amount of cleaning fluid is supplied to the wiping area of the the sheet material, while the kinetic energy of the jet flow of the cleaning fluid is converted by the porous sheet material from such unidirectional bundles of energy flows which undesirably drive ink or fiber flocks into firmer engagement with the blanket to multidirectional kinetic energy which desirably agitates the layer of the cleaning fluid supplied over the blanket, so that the kinetic energy supplied to the jet flow of the cleaning fluid effectively serves both for conveying a large amount of cleaning fluid at high rate and for agitating the cleaning fluid for the rub washing operation, thereby substantially increasing the cleaning efficiency.

The present invention is, based upon such a conception, to propose a device for cleaning a blanket mounted around a cylindrical drum of a printing machine, comprising a vessel means supported to be movable up and down so as selectively to approach a downwardly convexed bottom portion of said blanket with an upper opening thereof facing toward said convexed bottom portion of said blanket, a pair of rollers mounted in said vessel means adjacent said opening thereof so as to carry thereon as bridging therebetween a portion of a strip sheet material having a porous structure and suitable for rub cleaning and to press said bridging portion of said strip sheet material against said downwardly convexed bottom portion of said blanket when said vessel means is moved upward, a nozzle means mounted in said vessel means so as selectively to project a jet flow of a cleaning fluid upward against said bridging portion of said strip sheet material from a lower side thereof, a means for selectively driving said vessel means upward toward said downwardly convexed bottom portion of said blanket, and a means for selectively feeding said strip sheet material around said pair of rollers so that said bridging portion of said strip sheet material is shifted therealong.

The strip sheet material for use in the device according to the present invention may be a conventional woven or nonwoven cloth or paper made of natural or synthetic materials such as wood pulp, polyester, etc. The strip sheet material may be continuously supplied from a source thereof provided outside said vessel means to said bridging portion and exhausted therefrom after having been used. Alternatively, said strip sheet material may be an endless belt adapted to be circulated in said vessel means. The cleaning fluid may be conventional cleaning agents such as soapy water, organic solvent, etc.

Further, it would be more desirable, though not absolutely necessary, that the device of the present invention includes a squeezing means which contacts with the blanket in a squeezing manner when respective portions of the blanket have been applied with the cleaning action by the sheet material and the jet flow of the cleaning fluid, so that the cleaning fluid remaining in the blanket is squeezed out from the blanket. Such a squeezing means may preferably be a roller having a smooth cylindrical peripheral surface finished with a chrome plating or the like. The squeezing device may further include a squeeze blade having an edge kept in contact with said cylindrical peripheral surface of said squeeze roller for squeezing the cleaning fluid transferred onto the cylindrical peripheral surface of said squeeze roller off therefrom to be finally drained. The squeezing means provides advantages that the trace marks formed on the blanket surface by the cleaning cloth are deleted, the cleaning fluid remaining on the blanket surface is wiped out, and therefore the cleaning fluid need not be a highly volatile liquid thereby permitting use of various kinds of cleaning fluid. Further, it would be more desirable that the squeezing means are oscillatorily reciprocated in the directions parallel to the rotational axis of the blanket so as to avoid any particular trace marks being left on the blanket surface by the squeezing means.

BRIEF DESCRIPTION OF THE DRAWINGS

The present invention will be described in more detail in the form of preferred embodiments thereof with reference to the accompanying drawings, wherein.

DESCRIPTION OF THE PREFERRED EMBODIMENTS

Figure 1:
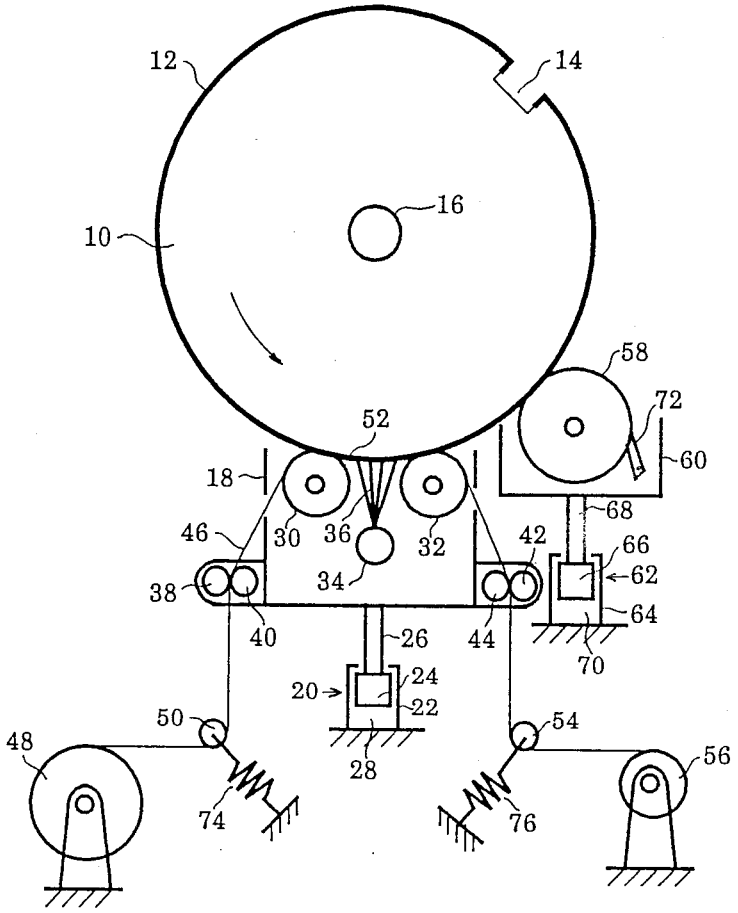
FIG. 1 is a schematic side view of an embodiment of the device according to the present invention.

Referring to FIG. 1, the device herein shown is adapted to clean a blanket 12 mounted around a cylindrical drum 10 of a printing machine, other details of said printing machine being omitted in the figure, since they are generally well known and are not directly concerned with the gist of the present invention. The drum 10 is formed with a groove 14 extending along a generatrix thereof, and opposite ends of the blanket 12 mounted around the drum 10 are fastened to the drum at opposite edges of the groove 14 by a fastening means not shown. The drum 10 is supported by a shaft 16 to be rotatable around a central axis thereof in the anticlockwise direction as shown by an arrow in the figure.

The device has a vessel 18 supported by a cylinder-piston means 20 to be movable up and down so that the upper open end of the vessel is selectively approached to a downwardly convexed bottom portion of the blanket. The cylinder-piston means includes a cylinder 22 and a piston 24. The cylinder 22 is mounted on a fixed structure. The piston 24 is connected with the vessel 18 via a piston rod 26. Selected supply of a pressure fluid to a pressure chamber 28 by any conventional means not shown in the figure or exhaust of the pressure fluid from the pressure chamber 28 causes selective up and down movement of the vessel 18.

A pair of rollers 30 and 32 are mounted in the vessel 18 arranged parallel relative to the drum 10 and spaced parallel from one another. These rollers may be supported from the vessel so as only freely to be rotatable about their own axes. A nozzle means 34 is also mounted in the vessel so as to project a jet flow 36 of a cleaning fluid upward through a space between the rollers 30 and 32 toward and against a downwardly convexed bottom portion of the blanket 12. The nozzle means 34 may preferably be a pipe extending in parallel with the rollers 30 and 32 and having a plurality of nozzle openings arranged along the length thereof. The nozzle means is adapted to be supplied with a pressurized cleaning fluid from a conventional pressurized fluid supply means including a pump, a reservoir, etc. not shown in the figure.

In the the embodiment shown in FIG. 1, a pair of nip rollers 38 and 40 are provided as schematically supported from the vessel 18 on one side thereof. Of course these rollers may be supported directly from a proper supporting structure which supports the vessel 18. Either one or both of the nip rollers 38 and 40 are adapted to be selectively braked by a braking mechanism not shown in the figure. Similarly, a pair of nip rollers 42 and 44 are provided as schematically supported from the vessel 18. Either one or both of the nip rollers 42 and 44 are adapted to be selectively driven by a proper conventional driving means not shown in the figure.

A strip sheet material 46 which may be a woven or nonwoven cloth or paper made of natural or synthetic materials is supplied from a source roll 48 as being conducted around a guide roller 50, through a nipping area between the nip rollers 38 and 40, around the rollers 30 and 32 thereby forming a bridging portion of the strip sheet material between the rollers 30 and 32, through a nipping area between the nip rollers 42 and 44, and around a guide roller 54 so as to be wound up as a recovery roll 56. The strip sheet material 46 is selectively fed through said path from the source roll 48 thereof to the recovery roll 56 thereof. Such selective feeding of the strip sheet material is controlled by the pair of the nip rollers 38 and 40 or the pair of the nip rollers 42 and 44 being selectively braked or driven according to a control program as described hereinunder.

On the rearside of the vessel 18 along the moving path of the blanket 12 a squeeze roller 58 is provided as rotatably supported by a vessel 60 which in turn is supported to be movable up and down by a cylinder-piston means 62 having a cylinder 64 and a piston 66, the vessel 60 being connected with the piston 66 by a piston rod 68. The cylinder 64 is stationarily supported. By selective supply of a pressure fluid to a pressure chamber 70 the vessel 60 is driven upward so that the squeeze roller 58 is shifted upward to come into contact with the blanket 12, and by exhaustion of the pressure fluid from the pressure chamber 70 the squeeze roller 58 is removed from the contact with the blanket 12. A blade 72 is provided as supported from the vessel 60 with an edge portion thereof being kept in squeezing contact with the outer peripheral surface of the squeeze roller 58.

During normal operation of the blanket 12, the rollers 30 and 32 are shifted downward not to contact with the blanket, and the squeeze roller 58 is also shifted downward not to contact with the blanket.

When the blanket 12 is to be cleaned, the vessel 18 is driven upward by the cylinder-piston means 20 so that the bridging portion 52 of the strip sheet material is pressed against a downwardly convexed bottom portion of the blanket 12 as supported by the rollers 30 and 32, and the nozzle means 34 is operated to project the jet flow 36 of a cleaning fluid against the bridging portion of the strip sheet material. The squeeze roller 58 is also shifted up by the piston-cylinder means 62.

During the cleaning operation, the drum 10 may be continuously driven at a rotating speed substantially lower than that in the printing operation. Alternatively, the drum 10 may be intermittently driven for small successive angular increments. The strip sheet material 46 supported around the rollers 30 and 32 is held not to move in the same direction as the blanket 12 as frictionally driven by the blanket on which the strip sheet material is pressed at said bridging portion thereof for applying the wiping action while the full circumferential length of the blanket traverses over said bridging portion of the strip sheet material for one time cleaning. Such holding of the bridging portion 52 of the strip sheet material against the traction applied by the rotating blanket is effected by braking the nipping rollers 38 and 40. A one time cleaning of the blanket may generally be to rotate the drum 10 for one rotation. However, if required for heavy contamination of the blanket, the cleaning for two or more rotations of the blanket may be done at one time cleaning.

The bridging portion 52 of the strip sheet material 46 may conveniently be renewed at a last stage of one time cleaning by feeding a length of the strip sheet material out from the source roll 48 while taking up a length of the strip sheet material on the recovery roll 56 corresponding to the length of the bridging portion of the strip sheet material. This feeding of the strip sheet material is done by loosening the braking action which has been applied to the nip rollers 38 and 40 with a correct timing during the last stage of the one time cleaning so that the strip sheet material is frictionally driven by the blanket due to the pressing engagement between the blanket and the rollers 30 and 32 sandwiching the strip sheet material therebetween.

Alternatively, the feed of the strip sheet material for renewing the bridging portion 52 thereof may be done in the period between two successive cleaning operations while the vessel 18 is shifted down so that the bridging portion 52 of the strip sheet material is out of contact with the blanket by the nip rollers 42 and 44 being timely driven for a programmed time duration so as to bring a new portion of the strip sheet material between the rollers 30 and 32. It would be desirable that a proper driving means is provided for resiliently driving the recovery roll 56 constantly or only when required. The guide rollers 50 and 54 are retained from a fixed structure by retaining means including, for example, tension springs 74 and 76, respectively, so as to maintain the strip sheet material 46 in a neatly expanded condition through the up and down movement of the vessel 18 and the rollers 30 and 32.

When the blanket 12 is rotated with the drum 10 for cleaning, with each downwardly convexed bottom portion of the blanket is successively brought into contact with the bridging portion 52 of the strip sheet material in such a manner that each downwardly convexed bottom portion of the blanket moves relative to the bridging portion 52 of the strip sheet material, so that each downwardly convexed bottom portion of the blanket is given a wiping cleaning action by the strip sheet material under the supply of an effluent amount of the cleaning fluid provided by the jet flow 36 of the cleaning fluid projected from the nozzle means 34. The cleaning fluid supplied in the form of such an upwardly projected jet flow has a substantial amount of upwardly directed unidirectional kinetic energy until the jet flow crashes against the bridging portion 52 of the strip sheet material which is now supported by the blanket 12 by contact therewith. However, after the crashing the unidirectional kinetic energy of the jet flow is diverted in all directions and agitates a layer of the cleaning fluid suspended by the bridge portion 52 of the strip sheet material along the downwardly convexed bottom portion of the blanket. This agitation of the layer of the cleaning fluid suspended in contact with the blanket expedites to release ink, fiber flocks or the like retained on the irregular surface structure of the blanket out therefrom.

Respective portions of the blanket which have been applied with such cleaning action is primarily squeezed by the pressing action applied by the roller 32 when they come out of the cleaning area extending between the rollers 30 and 32 so that most of the cleaning liquid retained by the micro irregular structure of the blanket is squeezed out therefrom. Subsequent to this, the blanket is applied with a further squeezing action by the squeeze roller 58, and thereby almost all of the cleaning fluid remaining in the blanket is removed therefrom. If the squeeze roller 58 is driven by a driving means not shown in the figure at such a speed that the surface of the squeeze roller 58 advances than the surface of the blanket by a small relative speed such as a few percent of their absolute speeds, the squeezing effect will be further increased. The cleaning liquid squeezed out from the blanket and transferred onto the surface of the squeeze roller 58 is squeezed out therefrom by a blade 72 and is finally drained toward the vessel 60.

The above sequential operations of the device shown in the drawing is only an example. One of ordinary skill in the art will understand that they may be modified in various manners.

Figure 2:
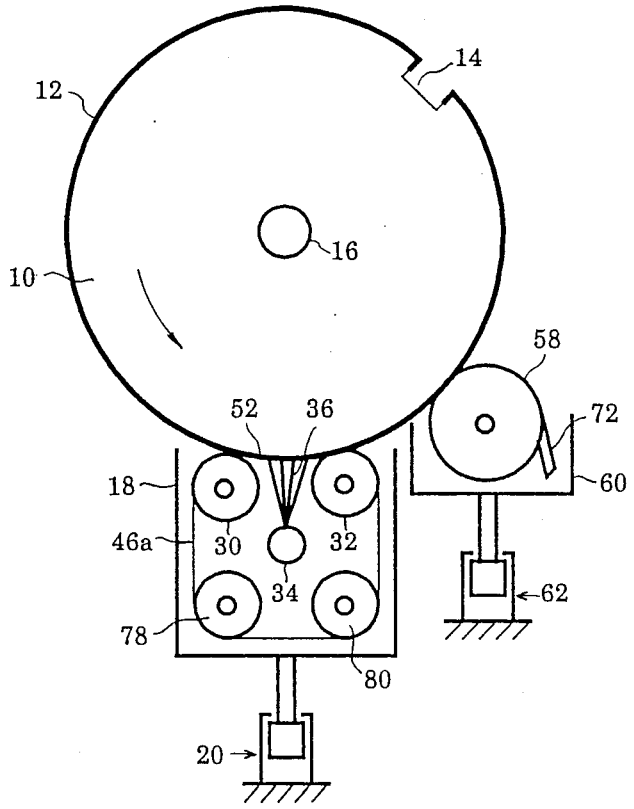
FIG. 2 is a schematic side view of another embodiment of the device according to the present invention.

FIG. 2 shows a second embodiment of the device according to the present invention. In FIG. 2, portions corresponding to those shown in FIG. 1 are designated by the same reference numerals as in FIG. 1. In this second embodiment, however, the strip sheet material 46*a* is provided in the form of an endless belt, and such an endless belt is adapted to be circulated around four rollers including the same rollers 30 and 32 as in the first embodiment shown in FIG. 1 and other two rollers 78 and 80. In this embodiment, since the strip sheet material 46*a* is repetitively used for a number of times of cleaning, it needs to be of a higher strength and durability. A woven cloth formed of strong and durable fibers will be desired. At least one of the rollers 30, 32, 78 and 80 is adapted to be selectively driven or braked by a driving/braking means which may be a conventional one and is therefore not shown in the figure. In this embodiment, the rub washing can be applied to the blanket by circulating the strip sheet material 46*a* while the blanket is stopped. Therefore, any desired degree of rub washing can be applied to the blanket while it makes one rotation. Further, the degree of rub washing applied to the blanket can be readily varied at different portions of the blanket according to the extents of contamination at the different portions which would be caused under particular natures of the prints to be produced.

It will be appreciated that the blanket cleaning device according to the present invention may conveniently be incorporated in a flat bed press or a rotary press, and operated as automatically controlled.

Although the invention has been shown and described in the form of preferred embodiments thereof, it would be understood by one of ordinary skill in the art that various modifications such as changes, omissions and/or additions with regard to the above described embodiments are possible without departing from the essential spirit of the present invention.

We claim:

1. A device for cleaning a blanket mounted around a cylindrical drum of a printing machine, said drum being mounted on an axis of rotation, comprising a vessel means supported to be movable up and down so as selectively to approach a downwardly convexed bottom portion of said blanket located vertically under said axis of rotation, said vessel having an upper opening thereof facing toward said vertically convexed bottom portion of said blanket, a pair of rollers mounted in said vessel means for rotation about horizontal parallel axes, said rollers being horizontally spaced apart and adjacent said opening thereof so as to carry thereon as bridging therebetween a portion of a strip sheet material having a porous structure and suitable for rub cleaning said pair of rollers being positioned on horizontally opposite sides of said vertically downwardly convexed bottom portion of said blanket so as to press said bridging portion of said strip sheet material against said vertically downwardly convexed bottom portion of said blanket when said vessel means is moved upward, a nozzle means mounted in said vessel means so as selectively to project a jet flow of a cleaning fluid upward to impinge against said bridging portion of said strip sheet material toward said vertically downwardly convexed bottom portion of said blanket, and a means for selectively feeding said strip sheet material around said pair of rollers so that said bridging portion of said strip sheet material is shifted therealong.

2. A device according to claim 1, wherein said strip sheet material is supplied from a source thereof provided outside of said vessel means to be passed over said pair of rollers and is recovered at an outside of said vessel means after having been passed over said pair of rollers.

3. A device according to claim 1, wherein said strip sheet material is an endless belt which is circulated in said vessel means.

4. A device according to claim 1, further comprising a pair of nip rollers supported by said vessel means so as to nip said strip sheet material at a portion thereof on an upstream side of said bridging portion thereof as viewed in a feeding direction of said strip sheet material, said nip rollers being adapted to be selectively braked.

5. A device according to claim 1, further comprising a pair of nip rollers supported by said vessel means so as to nip said strip material at a portion thereof on a downstream side of said bridging portion thereof as viewed in a feeding direction of said strip sheet material, said nip rollers being adapted to be selectively driven.

6. A device according to claim 1, wherein said nozzle means is a pipe having a plurality of nozzle openings formed therealong, said pipe being arranged in parallel with said pair of rollers.

7. A device according to claim 1, further comprising a squeezing means supported to be movable toward and away from said blanket so as selectively to contact with said blanket at a portion thereof passed over said vessel means, and a means for supporting said squeezing means to be movable toward and away from said blanket.

8. A device according to claim 7, wherein said squeezing means is a roller arranged in parallel with said cylindrical drum of said printing machine.

9. A device according to claim 8, wherein said squeezing means further comprises a blade having an edge kept in contact with a peripheral surface of said squeeze roller.

10. A device for cleaning a blanket mounted around a cylindrical drum of a printing machine, said drum being mounted for rotation on an axis of rotation, comprising:

a vessel means having an upwardly facing open top mounted vertically below the axis of said cylindrical drum so as to catch liquid from said drum;

a pair of rollers carried by said vessel means, mounted for rotation about horizontal parallel axes, said rollers being horizontally spaced apart and positioned to contact the convexed bottom portion of said blanket;

a strip of sheet material having a porous structure, said sheet extending over the outer periphery of and between said rollers to form a bridging portion therebetween for rub cleaning of the convexed bottom portion of said blanket;

nozzle means mounted in said vessel means between and below said pair of rollers so that jets of a cleaning fluid may be directed upwardly toward the underside of said bridging portion of said sheet material;

means for selectively moving said vessel and its rollers upwardly and downwardly so that said rollers cause the said bridging portion to contact or move away from the convexed bottom portion of said blanket; and means for selectively moving said sheet of strip material around said rollers so that said bridging portion is shifted therealong to bring a different portion of said strip material into rubbing contact with said blanket.

* * * * *